United States Patent [19]

Schultz

[11] Patent Number: 5,014,626

[45] Date of Patent: May 14, 1991

[54] FEMALE CONNECTING MEMBER WITH DISASSEMBLY FEATURE FOR ARTICULATED CONNECTION

[75] Inventor: Thomas R. Schultz, Lynwood, Ill.

[73] Assignee: Amsted Industries Incorporated, Chicago, Ill.

[21] Appl. No.: 425,026

[22] Filed: Oct. 23, 1989

[51] Int. Cl.[5] ..... B61D 17/00; F16C 43/02

[52] U.S. Cl. ..... 105/4.1; 105/3; 384/510

[58] Field of Search ..... 29/426.5, 898.08; 105/3, 4.1; 213/62 A, 62 R, 74, 75 R, 86; 384/510, 559–562

[56] References Cited

U.S. PATENT DOCUMENTS

| | | | |
|---|---|---|---|
| 1,980,156 | 11/1934 | Emrick | 29/898.08 X |
| 2,348,293 | 5/1944 | Hamer | 29/898.08 X |
| 3,716,146 | 2/1973 | Altherr | 213/75 R |
| 3,721,482 | 3/1973 | Tack et al. | 105/4.1 |
| 4,258,628 | 3/1981 | Altherr | 213/75 R X |
| 4,336,758 | 6/1982 | Radwill | 213/75 R X |
| 4,593,829 | 6/1986 | Altherr | 213/75 R |
| 4,867,071 | 9/1989 | Weber | 105/4.1 |

*Primary Examiner*—Robert P. Olszewski
*Assistant Examiner*—A. Muratori
*Attorney, Agent, or Firm*—Edward J. Brosius; Charles E. Bouton

[57] ABSTRACT

In an articulated connection, an improved female connecting member of the type having a ring seat within an annular groove is provided having an access passageway extending from an exterior surface of its front wall to a position at the annular groove which is covered by the ring seat. The access passageway provides for insertion and wedging of a tool between the ring seat and the floor of the annular groove to eject the ring seat from the annular groove during disassembly and maintenance of the articulated connection.

16 Claims, 3 Drawing Sheets

FEMALE CONNECTING MEMBER WITH DISASSEMBLY FEATURE FOR ARTICULATED CONNECTION

BACKGROUND OF THE INVENTION

The present invention relates generally to the repair of articulated connections in railway vehicles and, more particularly, to an improved female connecting member and method to facilitate removal of a ring seat from the female connecting member.

The use of articulated connections with male and female connecting members joining adjacent ends of railway cars on the bolster of a single truck to form a semi-permanent unit is well known and is shown in the following United States patents, among others: Tack et al, U.S. Pat. No. 3,721,482; Altherr, U.S. Pat. No. 3,716,146; Radwill, U.S. Pat. No. 4,336,758; and Altherr, U.S. Pat. No. 4,258,628.

Furthermore, the female connecting members of articulated connections are known to include an annular groove within which a spherical ring and ring seat are received to, in turn, act as a mounting surface for the male connecting member. The purpose of such spherical ring and ring seats are to allow, in part, for vertical and horizontal angling movement as well as rotational movement between the male and female connecting members when their respective railway cars are travelling on grades, around curves or rocking with respect to each other.

The use of such parts in an abutting relationship under high loads requires the maintenance of close tolerances to prevent high impact forces which cause excessive wear and possible fracture within the connection. During an extended period of service, the ring and ring seat and their respective opposing surfaces wear resulting in the lowering of the male connecting member and the car body to which it is secured. Consequently, a corresponding decrease in the restrictive space allocated for side bearing clearance occurs which is below the minimum height set by the American Association of Railroads. One way to restore the male connecting member to an acceptable height is to place a shim within the annular groove underneath the ring seat. This is done by disconnecting the male connecting member from within the female connecting member and lifting the ring and ring seat from within the annular groove; placing the shim within the annular groove; reinserting the worn ring and ring seat over top the shim; and reconnecting the male connecting member within the female connecting member.

A problem that has occurred during this maintenance procedure is that the ring seat often becomes lodged or "frozen" within the annular groove making it extremely difficult and sometimes impossible to lift out. If the ring seat cannot be removed during repair, it is then necessary to destroy the ring seat, typically accomplished by cutting it into several pieces using a cutting torch, to effect its removal. Such destruction of the ring seat requires the car owner to prematurely purchase a new ring seat.

SUMMARY OF THE INVENTION

Accordingly, it is an object of the present invention to provide an improved female connecting member with means for applying an upward force to the undersurface of a ring seat.

A further object of the proposed invention is to provide a method for ejecting a ring seat from a female connecting member.

By the present invention, it is proposed to overcome the difficulties encountered heretofore. To this end, it has been discovered that providing the female connecting member with one or more access passageways extending from the exterior surface of its front wall to the annular groove will allow for applying an upward force to the undersurface of the ring seat to eject the ring seat from the annular groove.

DESCRIPTION OF THE PREFERRED EMBODIMENT

Figure 1:
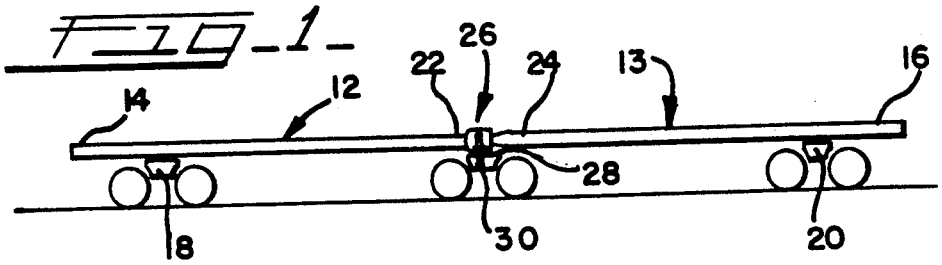
FIG. 1 is a simplified view of two railway cars being connected by an articulated connection and supported by a single truck therebelow to form a unit.

FIG. 1 shows a first railway car body 12 and a second railway car body 13, each having unattached ends 14 and 16 respectively which are supported by conventional railway trucks 18 and 20 respectively in a known manner. The inner end 22 of first railway car body 12 is joined to the inner end 24 of second railway car body 13 by an articulated connection 26 which is, in turn, carried on a bolster 28 of a single railway truck 30 to form a unit. It should be understood that more than two railway car bodies may be so joined to form a unit.

Figure 2:
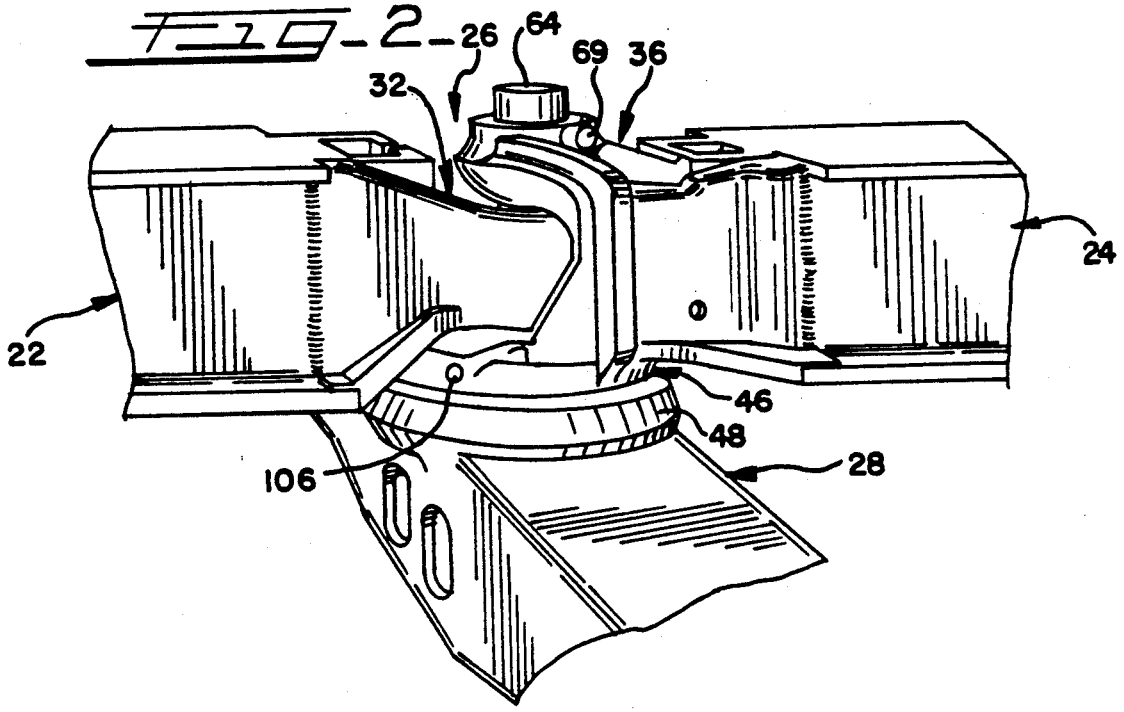
FIG. 2 is a perspective view of the articulated connection depicted in FIG. 1 and embodying the present invention.
Figure 3:
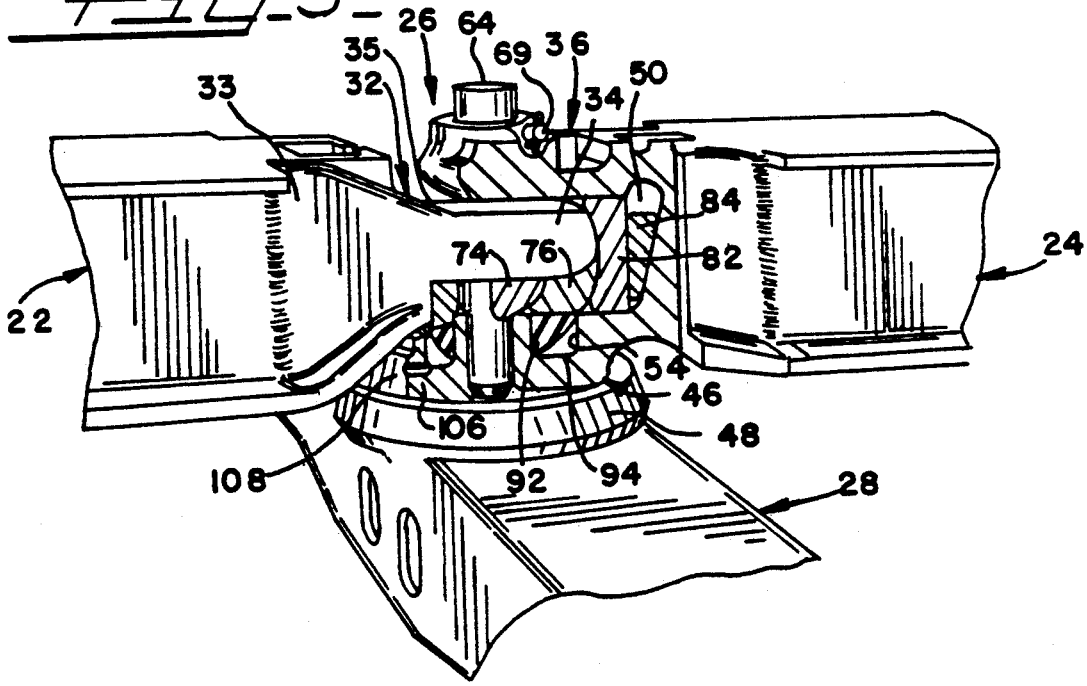
FIG. 3 is a perspective view of the apparatus of FIG. 2 in partial section.
Figure 4:
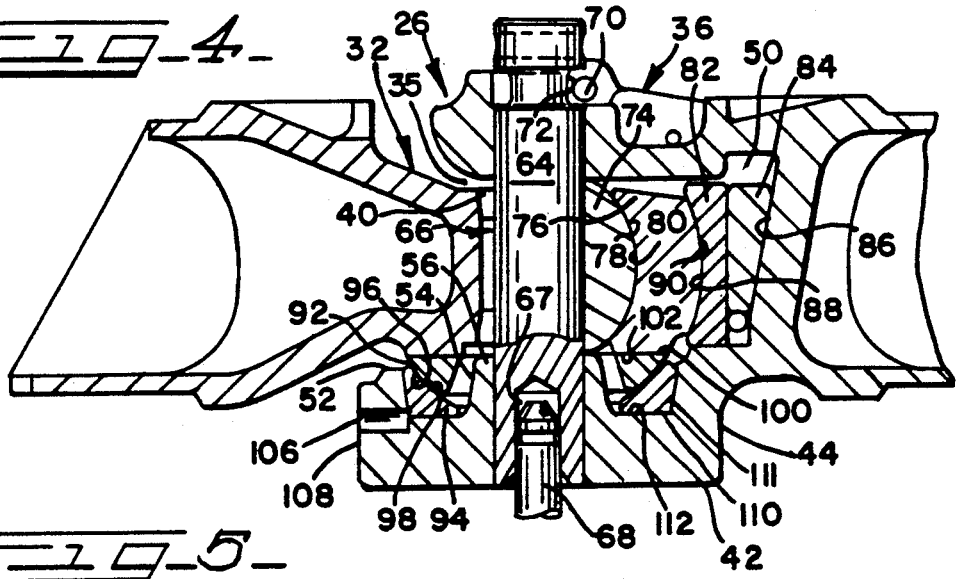
FIG. 4 is a side elevational view in section showing the articulated connection of FIG. 2.

In FIGS. 2–4, articulated connection 26 is shown in varying detail to include a male connecting member 32 having a front end 33 attached in a fixed manner to inner end 22 of first railway car body 12 and a rear or outer end 34 which is received in an open front end 35 of an improved female connecting member 36. Female connecting member 36 additionally has a rear end 38 attached in a fixed manner to inner end 24 of second railway car body 13. Outer end 34 of male connecting member 32 includes a vertical pin aperture 40. On a bottom 42 of female connecting member 36 is center plate bearing surface 44 which forms the inserting portion of a center plate joint 46. A corresponding center bowl 48 of center plate joint 46 is formed as part of bolster 28 of railway truck 30 and receives center plate bearing surface 44 therein.

Figure 5:
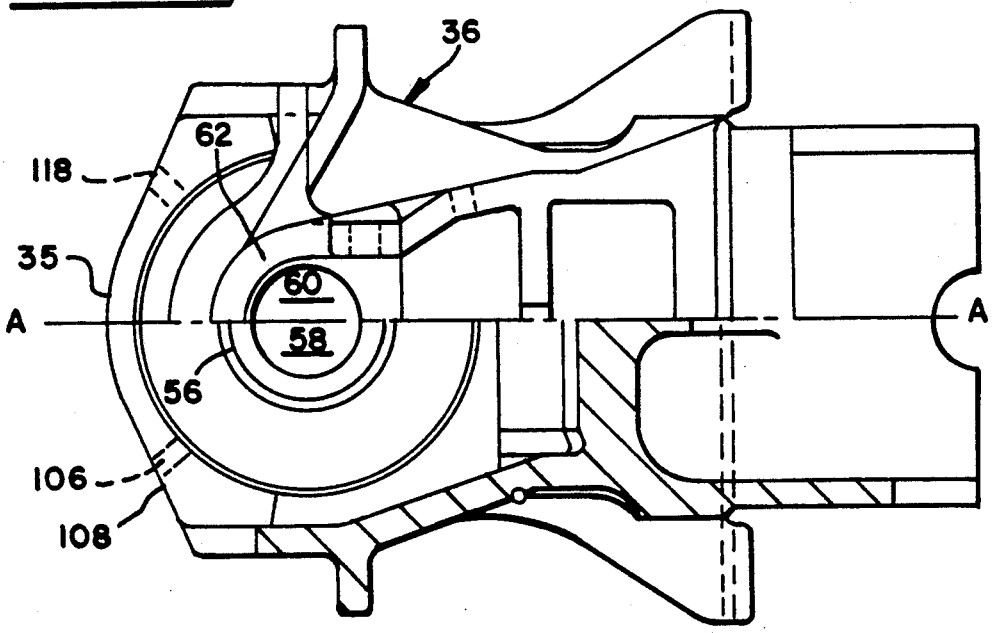
FIG. 5 is a top plan view, partially in section, showing a female connecting member of the articulated connection of FIG. 2.
Figure 6:
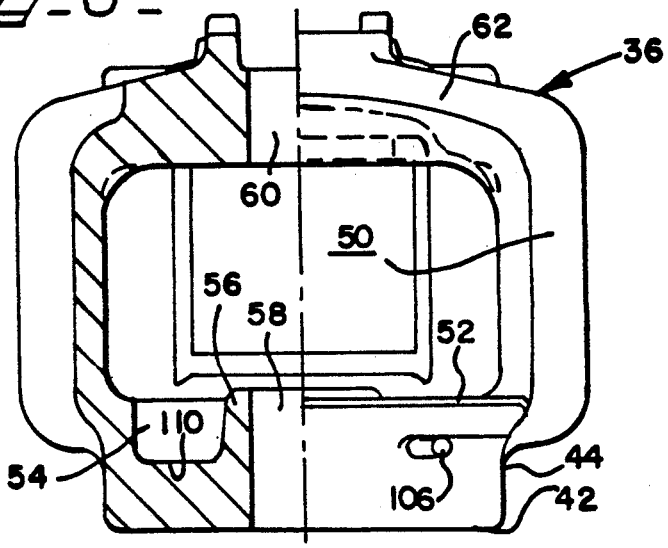
FIG. 6 is an elevational end view, partially in section, of the female connecting member shown in FIG. 5.

As can additionally be seen in FIGS. 5 and 6, the open front end 35 of female connecting member 36 leads to an inner cavity 50. In a bottom bounding surface 52 of inner cavity 50 is an annular groove 54 positioned about a circular hub 56. Annular groove 54 is bounded by a floor 112 on its bottom and by concentric raised inner 57 and outer walls 59 on its sides. A vertical circular aperture 58 extends through hub 56 and center plate bearing surface 44. Aperture 58 aligns with a second vertical circular aperture 60 extending through a top portion 62 of open front end 35 of female connecting member 36. A vertical primary pin 64 extends through apertures 58 and 60 in female connecting member 36 and through aperture 40 in male connecting member 32 forming a movable joint 66 between male connecting member 32 and female connecting member 36. A lower end of primary pin 64 is formed having a cylindrical cutout 67 to accommodate an upper end of a center pin 68, the lower end of which extends into center bowl 48 of center plate joint 46 on bolster 28. Primary pin 64 is secured against undesired vertical movement by a horizontal retaining pin 69 which passes through a horizontal aperture 70 in the top portion 62 of female connecting member 36. Retaining pin 69 also passes through an annular notch 72 located about the perimeter of primary pin 64 which permits rotation of primary pin 64 while providing against unintentional removal of primary pin 64 during use.

Movement between male connecting member 32 and female connecting member 36 is regulated in part by a pin bearing block 74 which is located within aperture 40 in male connecting member 32 between primary pin 64 and an end wall 76 of rear outer end 34 of male connecting member 32. The surface 78 of pin bearing block 74 which abuts end wall 76 is convex-shaped to correspond to the concave-shaped surface 80 of end wall 76. These corresponding shaped surfaces provide for vertical angling movement of male connecting member 32 relative to female connecting member 36.

In addition, movement between male connecting member 32 and female connecting member 36 is regulated in part by a follower 82 and a wedge shim 84 which are located between end wall 76 of male connecting member 32 and an innermost surface 86 of inner cavity 50 of female connecting member 36. The surface 88 of follower 82 which abuts end wall 76 is concave-shaped to correspond to the convex-shaped surface 90 of end wall 76. These corresponding shaped surfaces provide for both horizontal and vertical angling movement of male connecting member 32 relative to female connecting member 36. The wedge shim 84 provides for a slack-free connection. As in-service wear occurs, end wall 76 of male connecting member 32 tends to move away from surface 86 of inner cavity 50 of female connecting member 36. During such movement, wedge shim 84 drops to take up slack.

Movement between male connecting member 32 and female connecting member 36 is further regulated by a spherical ring 92 and ring seat 94, spherical ring 92 having an outer bottom radiused surface 96 complementary with an outer top radiused surface 98 on ring seat 94 for movement within ring seat 94. These complementary surfaces provide for horizontal and vertical angling movement as well as rotational movement between male connecting member 32 and female connecting member 36. Spherical ring 92 and ring seat 94 are received within annular groove 54 about hub 56 in female connecting member 36. An undersurface 110 of ring seat 94 meets the floor 112 of annular groove 54. A top surface 100 of ring 92 engages a flat undersurface 102 formed about aperture 40 in male connecting member 32.

Figure 7:
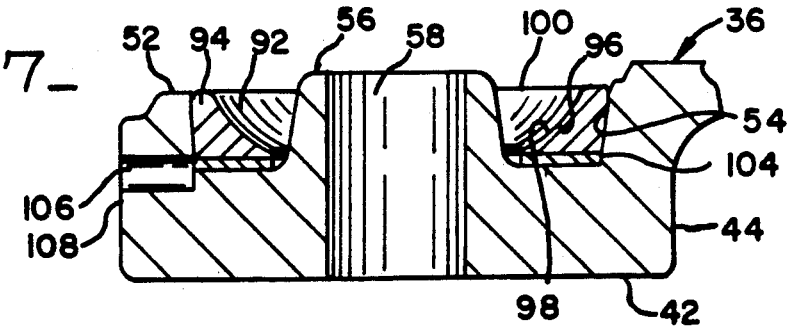
FIG. 7 is a partial elevational view in section of a female connecting member embodying the present invention and showing a shim underneath a ring seat.

While the railway vehicle is in service, wearing away of the metal occurs in surfaces 100 and 102 and to a greater extent in surfaces 96 and 98 resulting in the lowering of male connecting member 32 and car body 12 to which it is secured. Consequently, a corresponding decrease in the restrictive space allocated for side bearing (not shown) clearance occurs which is below the minimum standard set by the American Association of Railroads. One way to restore male connecting member 32 to an acceptable height is to place an annular shim 104 within annular groove 54 underneath undersurface 110 of ring seat 94 (as shown in FIG. 7). This is done by disconnecting male connecting member 32 from within female connecting member 36 and lifting ring 92 and ring seat 94 from within annular groove 54, placing shim 104 within annular groove 54 and replacing ring 92 and ring seat 94 over top shim 104. Lifting ring seat 94 from annular groove 54 is often made difficult by the lodging of ring seat 94 within said annular groove 54 due to the accumulation and solidification of lubricant, dirt and debris between the outer perimeter 111 of ring seat 94 and outer wall 59 of annular groove 54.

It has been found that restoration is facilitated by a method of ejecting ring seat 94 from annular groove 54, after first withdrawing male connecting member 32 from female connecting member 36, by applying or transmitting an upwardly directed force against the undersurface 110 of ring seat 94 from one or more locations outward of female connecting member 36. In this manner, physical impediments to removal are readily overcome and ring seat 94 is propelled out of annular groove 54.

Such a force may be applied by providing an access passageway 106 between locations on an outer portion 107 of annular groove 54 normally covered by ring seat 94 and an exterior surface 108 of female connecting member 36, and inserting a tool 116 against undersurface 110 of ring seat 94. In accordance with the location and attitude of access passageway 106, a sufficient force to eject ring seat 94 may be applied by wedging between undersurface 110 of ring seat 94 and floor 112 of annular groove 54, by levering or prying surfaces 110 and 112 apart, or by pushing upwardly against undersurface 110 thereof.

An apparatus for performing the foregoing method comprises an ejecting means extending between an exterior surface 108 of female connecting member 36 and outer wall 107 of annular groove 54. It is important that the ejecting means be located in an area of annular groove 54 that is normally covered by ring seat 94. It is additionally convenient to locate the ejecting means in an area of exterior surface 108 at a level above the portion inserted within center bowl 48 so as to be exposed for the application of an ejecting force without need to remove female connecting member 36 from center bowl 48 ("detrucking" is unnecessary). The ejecting means may take the form of one or more access passageways 106 extending from front exterior surface 108 of center plate 44 to outer wall 107 of annular groove 54 permitting insertion of a tool 116 against an undersurface 110 of ring seat 94. Access passageway 106 is most conveniently located at front open end 35 of female connecting member 36 which becomes fully exposed upon removing male connecting member 32.

Figure 8:
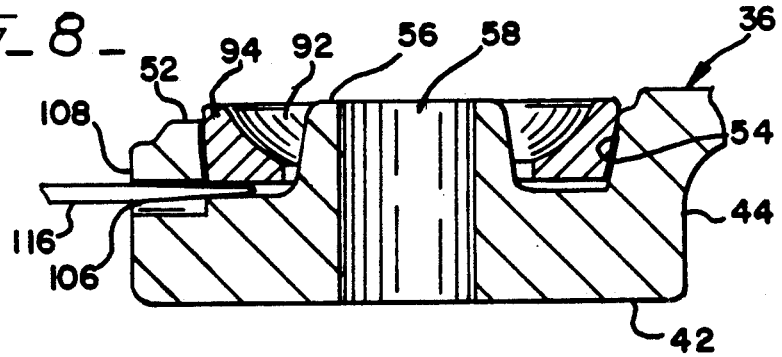
FIG. 8 is a partial elevational view in section of a female connecting member embodying the present invention and showing a tool inserted to wedge or pry a ring seat from an annular groove.

Once male connecting member 32 is disconnected from female connecting member 36, ring 92 and ring seat 94 may be ejected from angular groove 54 by inserting tool 116 in access passageway 106 in a number of different ways. For example, FIG. 8 shows tool 116 as a hardened tapered chisel point which is wedged between undersurface 110 of ring seat 94 and floor 112 of annular groove 54 and either pushed straight in wherein the natural taper of tool 116 provides an upward force to undersurface 110 of ring seat 94 to eject ring seat 94 or, if necessary, tool 116 may be pushed downward in a lever-like motion thus ejecting ring seat 94 from annular groove 54.

Figure 9:
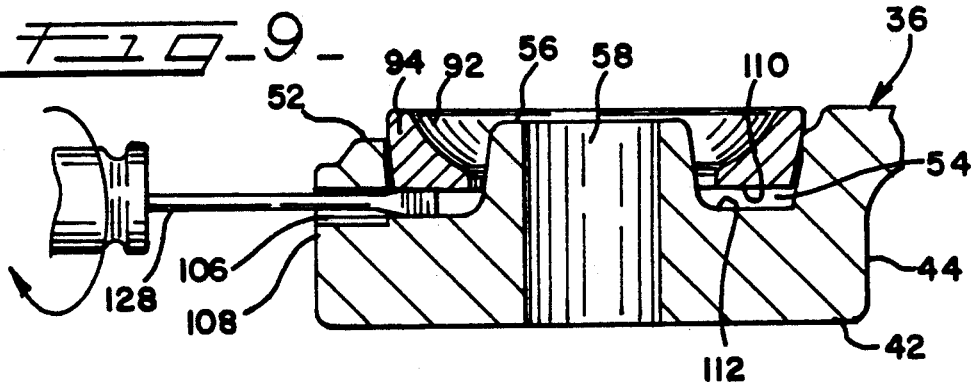
FIG. 9 is a partial elevational view in section of a female connecting member embodying the present invention showing a tool rotated to eject a ring seat from an annular groove.

An alternative method of ejecting ring seat 94 is shown in FIG. 9 in which a tool 128 such as a screwdriver is wedged between undersurface 110 of ring seat 94 and floor 112 of annular groove 54 and rotated providing a similar upward force to pry undersurface 110 of ring seat 94 from floor 112 of annular groove 54.

Figure 10:
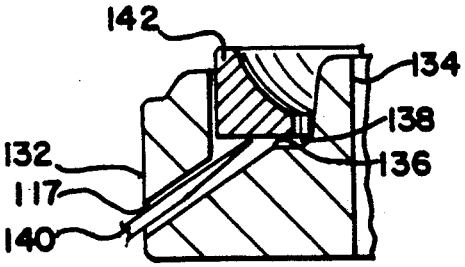
FIG. 10 is a partial elevational view in section of an alternative embodiment of a female connecting member of the present invention in which an access passageway is vertically offset and showing a tool inserted to punch a ring seat up from an annular groove.

Another alternative method is shown in FIG. 10 in which access passageway 117 extends at an angle from front exterior surface 132 of female connecting member 134 to the floor 136 of angular groove 138 and a tool 140 such as a punch is inserted in access passageway 117 to undersurface 141 of ring seat 142. Tool 140 is then pushed straight in providing an upward force on undersurface 110 of ring seat 142, thus ejecting ring seat 142 from annular groove 138.

It is preferred that passageway 106 be substantially horizontal at a level in which the center point of passageway 106 is at the same vertical height as that at which undersurface 110 of ring seat 94 meets floor 112 of annular groove 54. Alternatively, the access passageway may be offset so as to extend at an angle from front exterior surface 108 to annular groove 54. By way of example, an access passageway 117 is shown to extend at a vertical offset in the alternative embodiment of FIG. 10.

While access passageway 106 may be located at any position in female connecting member 36 and be directed in any such way which will provide for insertion of tool 116 to apply an upward force to undersurface 110 of ring seat 94 to, in turn, eject ring seat 94 from annular groove 54, it has been found that stress conditions are most favorable when access passageway 106 is located in front exterior surface 108 of female connecting member 36 at a 45° angle radially from longitudinal centerline A-A of railway car bodies 12 and 13. In addition, stress conditions are most favorable when the center line of access passageway 106 is positioned to be directed through the center of hub 58.

Alternatively, a second access passageway 118 may be located in front exterior surface 108 of female connecting member 36 at a 45° angle radially from the longitudinal centerline A-A but on the opposite side of centerline A-A from access passageway 106. This provides for the insertion of a second tool (not shown) resulting in a greater upward force to undersurface 110 of ring seat 94 in the case of a ring seat 94 which is extremely difficult to dislodge from annular groove 54. Furthermore, second access passageway 118 provides a convenient alternative point of insertion of a tool in the case where access from either side of centerline A-A is desired.

Figure 11:
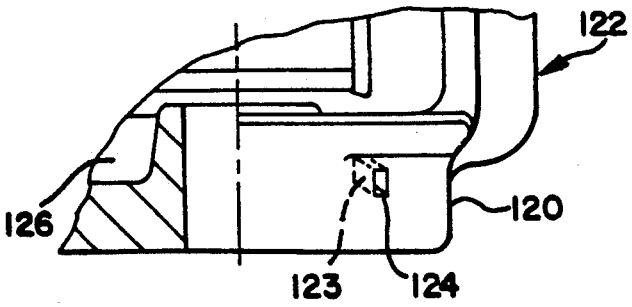
FIG. 11 is a partial elevational view of an alternative embodiment of a female connecting member of the present invention in which the access passageway has a rectangular cross-section.

The preferred embodiment of the invention consists of an access passageway 106 with a circular cross section which provides for ease and lower cost of manufacturing. In the alternative, an access passageway may be of any shape desired. For example, FIG. 11 shows a centerplate bearing surface 120 of a female connecting member 122 including access passageway 123 extending from front exterior surface 124 to annular groove 126 and having a rectangular slot-like configuration which may be preferred for a corresponding shaped tool (not shown) to be used to lift a ring seat (not shown) from annular groove 126.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. An improved female connecting member in an articulated connection for joining adjacent railway cars wherein a male connecting member is secured to an end of one of said cars and said female connecting member is secured to an end of the other of said cars, said male connecting member is received in an open end of said female connecting member having an annular groove for receipt of a ring seat providing for support of said male connecting member while allowing for vertical and horizontal movement therebetween, the improvement comprising:

at least one access passageway in said female connecting member, said access passageway having a first end and a second end, said first end of said access passageway located in an exterior surface of said female connecting member, said second end of said access passageway located at said annular groove at a position which is covered by said ring seat to provide for the insertion of a tool to apply a force to an undersurface of said ring seat with sufficient force to eject said ring seat from said annular groove.

2. The invention according to claim 1 in which said ring seat includes an outer top radiused surface complementary with an outer bottom radiused surface of a spherical ring, said complementary surfaces providing for movement between said male and female connecting members.

3. The invention according to claim 1 in which said access passageway is located in a front wall of said open end of said female connecting member.

4. The invention according to claim 1 in which the centerpoint of said first end of said access passageway and said second end of said access passageway are at the same height causing said access passageway to be substantially horizontal.

5. The invention according to claim 1 in which the centerpoint of said first end of said access passageway is offset vertically relative to the centerpoint of said second end of said access passageway causing said access passageway to extend at an angle from said exterior surface of said female connecting member to said annular groove.

6. The invention according to claim 1 in which said annular groove is bounded by a floor on its bottom and by concentric raised inner and outer walls on its sides.

7. The invention according to claim 6 in which said undersurface of said ring seat rests upon said floor of said annular groove.

8. The invention according to claim 6 in which said second end of said access passageway is located in said outer wall about said annular groove.

9. The invention according to claim 6 in which said second end of said access passageway is located in said floor of said annular groove.

10. The invention according to claim 1 in which said access passageway has a circular cross-section.

11. The invention according to claim 1 in which said access passageway has a rectangular cross-section.

12. The invention according to claim 1 wherein there are more than one access passageways providing for the insertion of two or more tools resulting in a greater application of force to said undersurface of said ring seat to eject said ring seat from said annular groove.

13. An improved method of removing a ring seat from an annular groove of a female connecting member of an articulated connection for joining adjacent railway cars in which a top surface of said ring seat provides support for a male connecting member received in an open end of said female connecting member, said method comprising: removal of said male connecting member from said ring seat; inserting a tool through an access passageway located between an exterior surface of said female connecting member and said annular groove; applying a force with said tool against an undersurface of said ring seat thereby ejecting said ring seat from said annular groove.

14. The method according to claim 13 in which said removing of said ring seat from said annular groove is achieved by inserting said tool through said access passageway between said ring seat and said annular groove and using said tool as a lever to pry said ring seat from said annular groove.

15. The method according to claim 13 in which said removing of said ring from said annular groove is achieved by inserting said tool through said access passageway between said ring seat and said annular groove and rotating said tool to pry said ring seat from said annular groove.

16. The method according to claim 13 in which said removing of said ring seat from said annular groove is achieved by inserting said tool through said access passageway to said undersurface of said ring seat and pushing said tool upwardly to punch said ring seat from said annular groove.

* * * * *